US006883182B2

(12) United States Patent
Necci et al.

(10) Patent No.: US 6,883,182 B2
(45) Date of Patent: Apr. 26, 2005

(54) PIVOT MASK

(75) Inventors: Raymond M. Necci, Lancaster, NY (US); Valentin A. Castro, Williamsville, NY (US)

(73) Assignee: AVOX Systems, Inc., Lancaster, NY (US)

( * ) Notice: Subject to any disclaimer, the term of this patent is extended or adjusted under 35 U.S.C. 154(b) by 77 days.

(21) Appl. No.: 10/150,346

(22) Filed: May 17, 2002

(65) Prior Publication Data

US 2002/0184691 A1 Dec. 12, 2002

Related U.S. Application Data

(60) Provisional application No. 60/292,990, filed on May 23, 2001.

(51) Int. Cl.[7] ..... A42B 1/24

(52) U.S. Cl. ..... 2/422; 2/6.2; 2/424

(58) Field of Search ..... 2/422, 424, 10, 2/6.2; 128/201.24, 201.23, 202.27; 248/478, 185.1, 183.3; 403/146, 161, 95, 84, 73, 97, 92, 103; 411/984, 956, 965, 989

(56) References Cited

U.S. PATENT DOCUMENTS

| | | | | | |
|---|---|---|---|---|---|
| 575,266 | A | * | 1/1897 | McCollum et al. | 74/551.5 |
| 3,035,573 | A | | 5/1962 | Morton, Jr. et al. | |
| 3,065,747 | A | * | 11/1962 | William | 128/201.24 |
| 3,730,474 | A | * | 5/1973 | Bowers | 248/478 |
| 4,136,403 | A | * | 1/1979 | Walther et al. | 2/10 |
| 4,645,224 | A | * | 2/1987 | Poganski | 280/47.17 |
| 4,689,836 | A | * | 9/1987 | Vitaloni | 2/424 |
| 5,003,632 | A | * | 4/1991 | Claude | 2/422 |
| 5,190,390 | A | * | 3/1993 | Ming-Tai | 403/24 |
| 5,879,100 | A | * | 3/1999 | Winkler | 403/325 |
| 5,987,652 | A | * | 11/1999 | Fowler | 2/424 |
| 6,266,850 | B1 | * | 7/2001 | Williams et al. | 16/430 |
| 6,301,720 | B1 | * | 10/2001 | Bataille et al. | 2/422 |

OTHER PUBLICATIONS

Scott Brochure; Pressure–Breathing Demand Oxygen Mask; Apr. 1999; 4 pages.

* cited by examiner

*Primary Examiner*—Rodney M. Lindsey
(74) *Attorney, Agent, or Firm*—Hodgson Russ LLP

(57) ABSTRACT

The present invention relates to a device to rotate a previously unrotatable receiver used with helmets, preferably aircraft helmets.

4 Claims, 6 Drawing Sheets

PRIOR ART

PIVOT MASK

CLAIM OF PRIORITY

This application claims priority to U.S. provisional patent application No. 60/292,990, filed on May 23, 2001.

FIELD OF THE INVENTION

The present invention relates to a helmet used in association with aviation, particularly military aircraft.

DESCRIPTION OF RELATED ART

Currently, most military aircrews are required to wear a helmet when in flight. Those aircrew members that require an oxygen mask, as shown in FIG. 1, the mask 10 is normally secured to their helmet 12 through a mask mounted assembly of straps 14 and spring loaded bayonets 18. On each side of the helmet 12 is a receiver 20 that the bayonet 18 locks into. Locking the bayonet 18 to the receiver 20 is performed through teeth components (shown and described in U.S. Pat. No. 3,035,573) in the receiver 20 and spring loaded components (also shown and described in U.S. Pat. No. 3,035,573) on the bayonet 18.

When a pilot is fitted for a helmet 12, the receivers 20 are manually located on the helmet to optimize the mask 10 fit for that individual. Then holes (not shown) are drilled to affix the receiver 20 to the helmet 12 through screws (not shown). To complicate matters, each mask 10 a pilot may wear may require the receiver 20 be mounted at a different angle. In other words, the pilot may require a new helmet be fitted and drilled when a new mask is used or must have a plurality of helmets 12, one for each particular mask 10.

This non-swiveling receiver 20 is disclosed in U.S. Pat. No. 3,035,573, which is an expired patent owned by the assignee of this application.

The present invention solves the multiple helmet problem.

SUMMARY OF THE INVENTION

The present invention relates to a device to rotate a previously unrotatable receiver used with helmets, preferably, in the aircraft industry.

DETAILED DESCRIPTION OF THE PREFERRED EMBODIMENTS

The present invention is an improvement over the prior non-swiveling receivers 20 because the present invention is directed to a partially to fully (if desired), as shown in FIGS. 2–9, rotatable and securable receiver 30.

Figure 1:
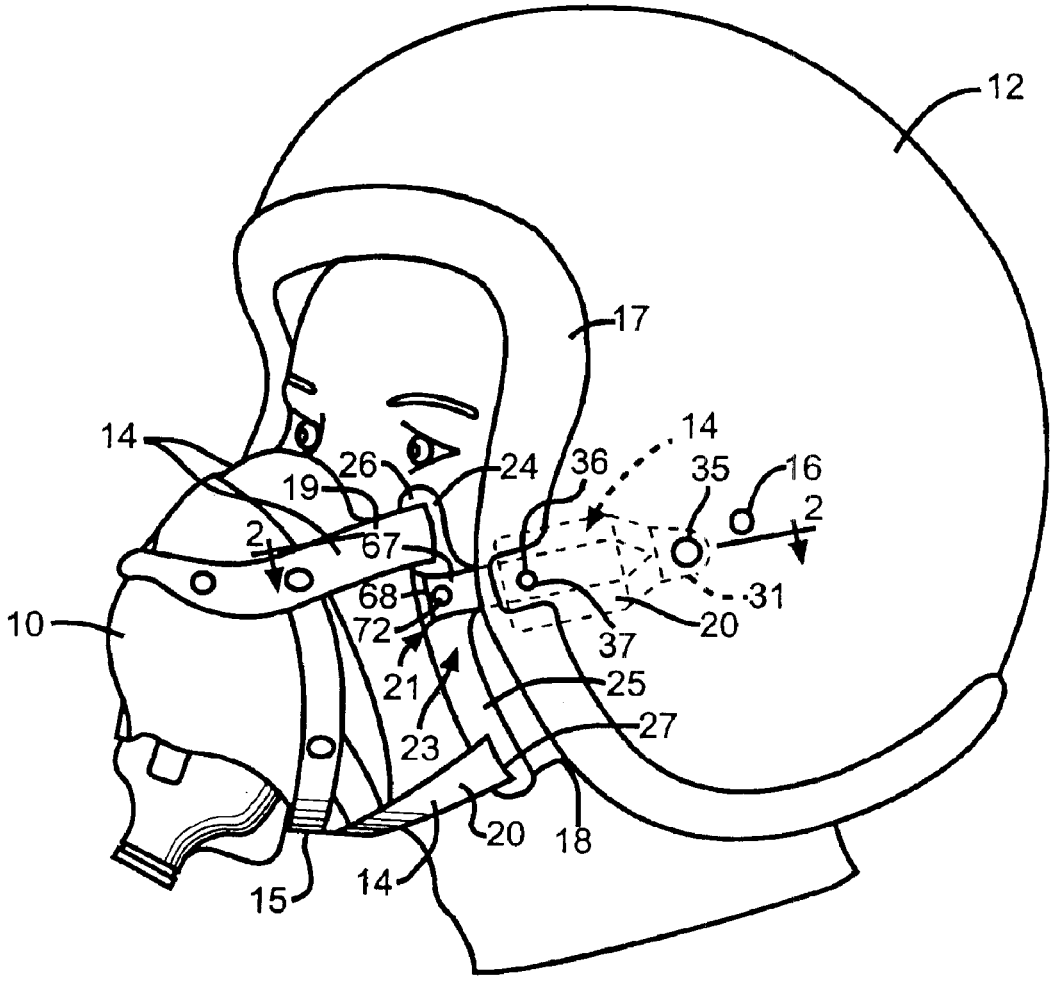
FIG. 1 is an illustration of the prior art.
Figure 3:
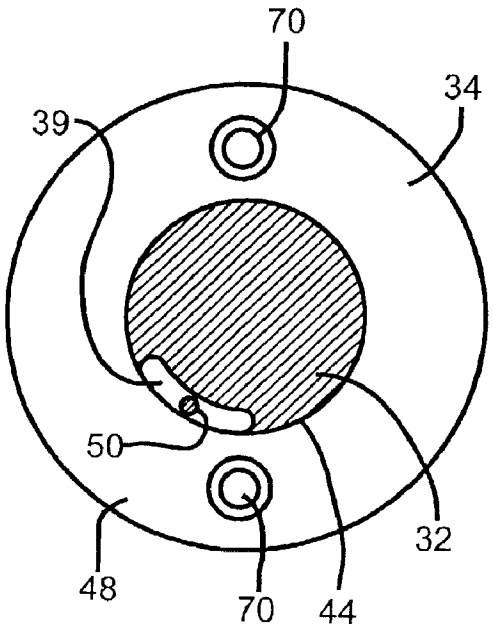
FIG. 3 is an illustration of the bottom of the present invention shown in FIG. 2.
Figure 2:
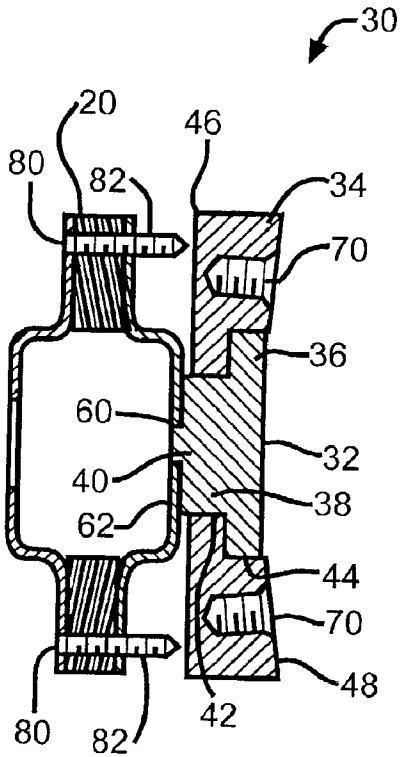
FIG. 2 is a cross-sectional view of the present invention.
Figure 4:
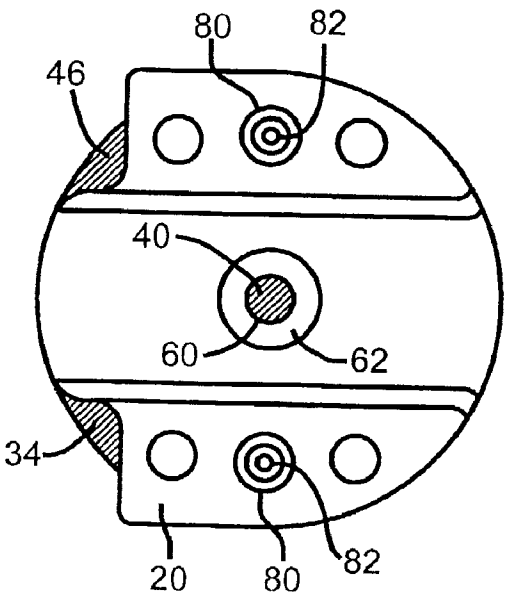
FIG. 4 is an illustration of the top of the present invention shown in FIG. 2.

The partially to fully rotatable and securable receiver 30, as shown in FIGS. 2–4, has, in one embodiment, a conventional receiver 20 mounted to a stud 32, and a mounting plate 34. The stud 32 has at least a body portion 36, a neck portion 38, and a head portion 40. Each portion 36, 38, and 40 can be of any shape so long as each portion is able to rotate a predetermined distance within the mounting plate 34. As such, the portions 36, 38, and 40 have a generally circular shape, as shown in FIGS. 2–4, with a smooth slide partition 39 in the body portion 36.

In particular, the body portion 36 has a diameter, excluding the slide partition, of A, the neck portion 38 has a diameter of B which is less than the diameter A, and the head portion 40 has a diameter of C, which is less than the diameter of B. Preferably, each portion 36, 38, and 40 has the center of its diameter immediately above the center of the other portion and in the following order, head portion 40 over the neck portion 38 which is over the body portion 36. That way, the stud 32 rotates smoothly within the mounting plate 34.

The mounting plate 34 has a top surface 46, a bottom surface 48, a neck aperture 42, a body indentation 44 (shown in FIGS. 2 and 3), and a rotation guide 50 (shown in FIG. 3). When the mounting plate 34 receives the stud 32, the indentation 44 positions the body portion 36 and the neck aperture 42 positions the neck portion 38. The body portion 36, however, has to be aligned within the body indentation 44 in such a way that the rotation guide 50 is within the slide partition 39 as shown in FIG. 3.

By inserting the rotation guide 50 within the slide partition 39, the rotation of the receiver 20 is limited to a predetermined rotation. In the embodiment illustrated in FIG. 3, the rotation of the receiver 20 is limited to sixty degrees. The amount of rotation is a predetermined value that can be adjusted by increasing or decreasing the length of the slide partition 39. Accordingly, the length of the slide partition 39 could allow 360°, but preferably up to 180° and most preferably up to 90°.

The receiver 20 rotates the predetermined distance because the head portion 40 is connected to the receiver 20. In the present embodiment illustrated in FIG. 2, the head portion 40 extends into a head aperture 60 of a bottom surface 62 of the receiver 20. The head portion 40 can be welded, crimped, screwed, or any other conventional method to attach the head portion 40 to the bottom surface 62.

The mounting plate 34 has at least one mounting aperture 70 that allow the mounting plate 34 to be mounted to the helmet 12. The mounting plate 34 can be mounted to the helmet 12 by any conventional method, such as at least one screw, or adhesive (not shown).

As stated previously, the receiver 20 was mounted to the helmet 12 by at least one screw through at least one mounting aperture (two are shown). The mounting aperture, for this embodiment, is now called a set point aperture 80. Each set point aperture 80 receives a set screw 82. Once the receiver 20 is in the desired position, the user tightens each set screw 82 so the set screw 82 contacts the mounting plate 34. At which point, the receiver 20 on the receiver 30 is secured in position and can be used by the aircrew.

Figure 5:
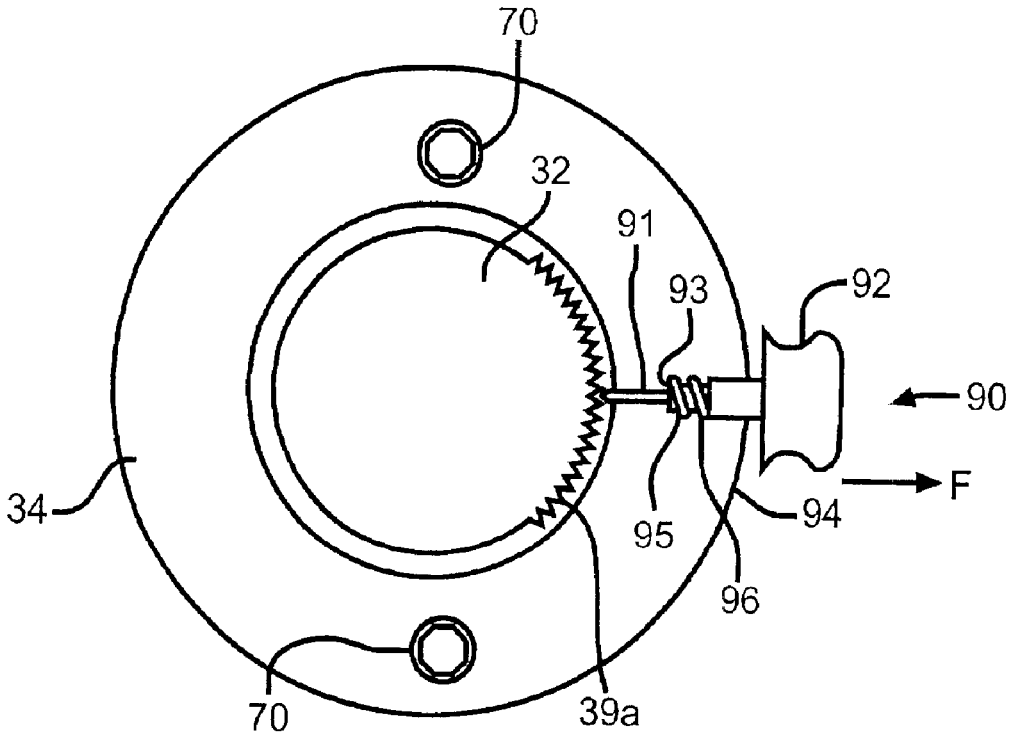
FIG. 5 is an alternative embodiment of FIG. 3.

FIG. 5 illustrates an alternative embodiment of the mounting plate and the stud. Instead of having a slide aperture 39, the stud has a toothed surface 39A along a portion of the body portion. In addition, the mounting plate 34 has a locking plunger 90 designed to contact the toothed surface 39A. The locking plunger 90 has a shaft 91 with a spring plate 93, a knob 92 on the exterior surface of the mounting plate 34, and the shaft 91 extends through a plunger aperture 94 of the mounting plate. Within the plunger aperture 94 is a spring cavity 95 that contains a resilient member 96 that forces the shaft 91 and the spring plate 93 toward the toothed surface 39*a*. Accordingly, when the resilient member 96 is in its relaxed state, the shaft 91 applies pressure to the toothed surface 39*a* which prevents the receiver 20 from altering its position. In contrast, when a force F (in the direction of the arrow in FIG. 5) is applied to the knob 92, the shaft 91 applies no pressure to the slide aperture 39*a* which allows the receiver 20 to rotate the predetermined distance within the toothed surface area 39*a* and still be able to be locked in position.

Figure 6:
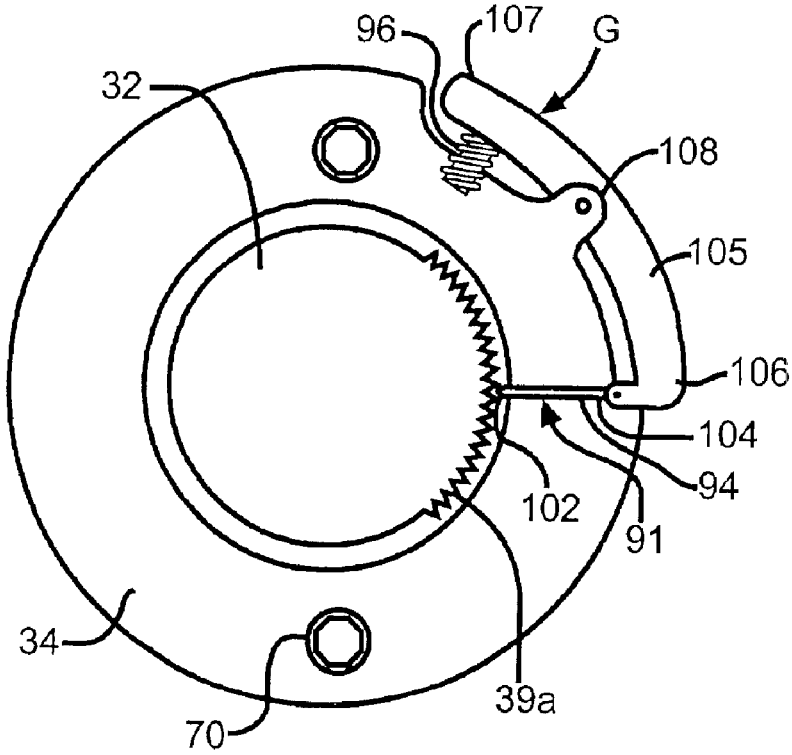
FIG. 6 is an alternative embodiment of FIG. 3.

FIG. 6 is an alternative embodiment of FIG. 5. In this embodiment, there is a locking lever 105 which has the shaft 91. The distal end 102 of the shaft 91 penetrates through a plunger aperture 94 to the toothed surface 39*a*. The proximal end 104 of the shaft 91 is connected to the distal part 106 of the lever 105. The lever 105 has a fulcrum 108 that extends from the mounting plate 34 and a resilient member 96 connected to the proximal point 107 of the lever 105. When a force G is applied to the proximal point in the direction of the arrow shown in FIG. 6, then the shaft 91 applies no pressure to the toothed surface 39*a* so the receiver 20 can rotate. Otherwise, if no pressure is applied to the proximal end 105 then the receiver 20 is unable to rotate.

Figure 7:
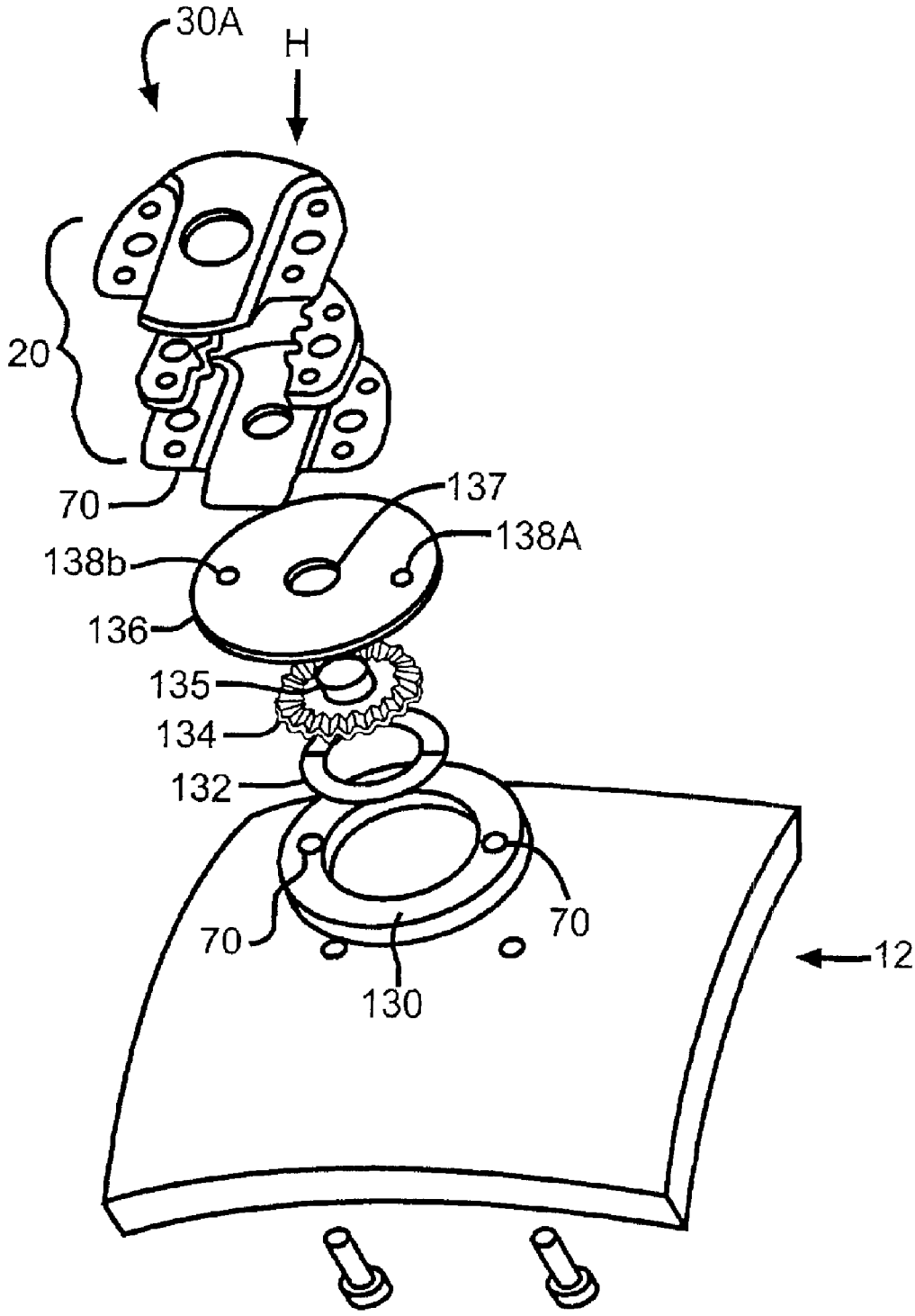
FIG. 7 is an exploded view of an alternative embodiment of the present invention.

FIG. 7 illustrates another embodiment of the present invention. This embodiment 30*a* has a mounting ring 130, a wave washer 132, a first locking gear 134 with an extension 135, a second locking gear 136 with an extension aperture 137 and at least two mounting apertures 138*a*, 138*b*, and a receiver 20.

The mounting ring 130 receives, in order, the wave washer 132, the first locking gear 134, and the second locking gear 136. The mounting ring 130 is directly mounted to the helmet 12 the same way the mounting plate 34 is connected to the helmet 12, and conventional securing mechanisms, screws, adhesives and the like, also connect the second locking gear 136 to the mounting ring 130 through the mounting apertures 138*a,b*.

The extension 135 extends through the extension aperture 137 and connects with the receiver 20, like the head portion 40 connects to the receiver 20 as shown in FIG. 2. Thereby, when the user wants to rotate the receiver 20, the user applies a force H to the receiver 20 which results in the first locking gear 134 disengaging from the corresponding second locking gear 136 so the receiver 20 can be rotated. And when the receiver 20 is to be in a locked position, then no pressure in the direction of H is applied to the receiver 20.

Figure 8:
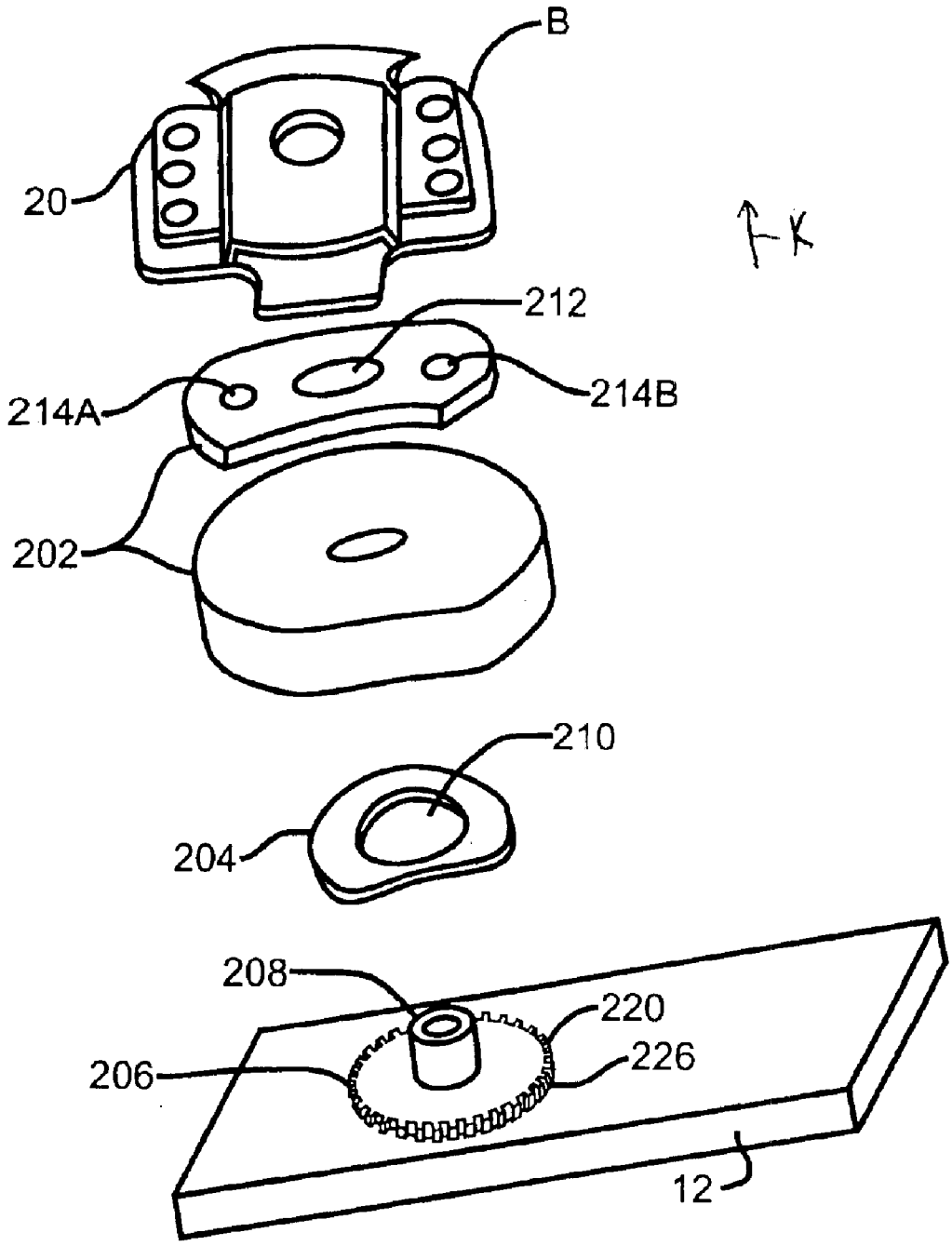
FIG. 8 is an alternative embodiment of FIG. 7.

Turning to FIG. 8, the present invention can also be designed with a receiver 20, a housing 202, a resilient member 204 (like a wave washer or any other conventional resilient member like a spring), and a position device 206 (like a sprocket which is disk shaped or any other shape that can rotate within the housing 202) having an extension 208 and a base 220. The extension 208 extends through an aperture 210 of the wave washer 204, and an aperture 212 of the housing 202 so it can be connected to the receiver 20 in the same way that head portion 40 connects to the receiver 20. The housing 212 is mounted to the helmet 12 through apertures 214*a, b*, in the same way the mounting plate is connected to the helmet 12.

Figure 9:
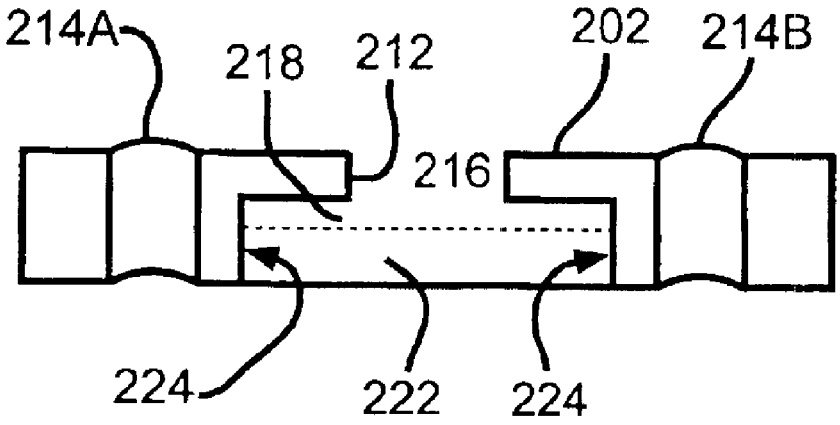
FIG. 9 is an enlarged cross-sectional view of housing 202.

Turning to FIG. 9, the aperture 212 of the housing has at least three levels. The first level 216 has an opening of B which is greater than the lateral extension (which could be a diameter if shaped like a circle or a width if any other shape) of the extension 208, and is located adjacent to the receiver 20. The second level 218 has an opening C, which is greater than the opening B and the lateral extension of the base 220. The third level 222 is positioned toward the helmet 12, has an opening greater than the lateral extension of the base 220, and has at least one protrusion 224. The protrusions 224 are designed to fit within indentations 226 of the base 220. There has to be a minimum of two indentations 226 (otherwise there is no way the receiver can be repositioned). In addition, the number of indentations is directly relational to the number of positions that the receiver can be positioned.

This embodiment operates in such a manner that when a user pulls the receiver 20 away from the helmet 12 [force K], the position device 206 is raised from the third level 222 to the second level 218. When the base 226 is within the second level 218, the wave washer 204 is compressed, and the receiver 20 can be rotated to a desired position.

The wave washer 204 pushes the base 226 into the third level 222 when the user releases the receiver 20. When the base 226 is in the third level 222, the receiver 20 is securely positioned.

Figure 10:
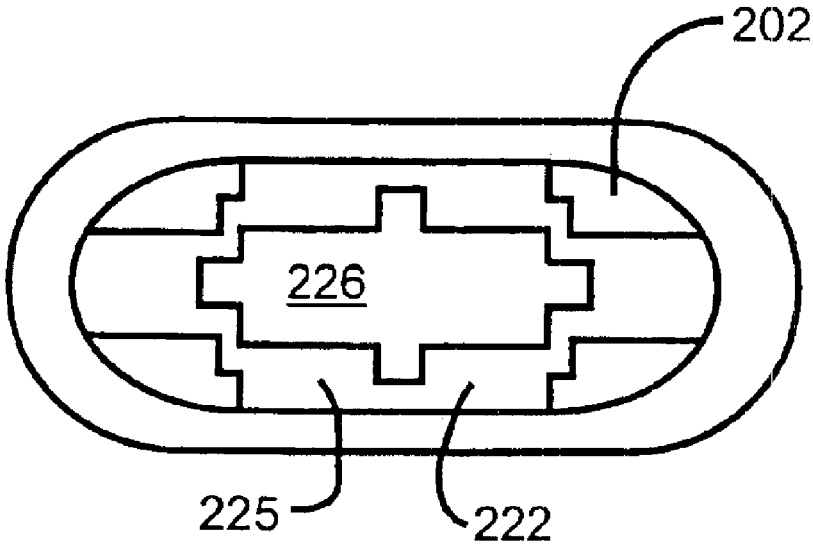
FIG. 10 is an alternative embodiment showing the top view of the third level and the base of the present invention

In an alternative embodiment of FIGS. 8 and 9, the present invention has the protrusion 224 extending from the base 220, and a receiving cavity 225 in the housing positioned adjacent the third level 222, as shown in FIG. 10.

Although variations in the embodiment of the present invention may not each realize all the advantages of the invention, certain features may become more important than others in various applications of the device. The invention, accordingly, should be understood to be limited only by the scope of the appended claims.

We claim:

1. A rotatable receiver comprising:

a receiver;

a position device having a base with at least two indentations and an extension protruding therefrom;

a housing having an aperture that receives the extension to allow the extension to connect to the receiver, the aperture has at least a first, second and third levels wherein the first level has an opening that is greater than the lateral extension of the extension, the second level has an opening greater than the lateral extension of the base so the base can rotate within the second level; and the third level has an opening greater than the lateral extension of the base and at least one projection, wherein the projection extends into at least one indentation when the receiver is removably secured in a desired position;

when the receiver is to be rotated, the base is positioned in the second level; and wherein the rotatable receiver is connected to a helmet.

2. The receiver of claim 1 wherein the base is spherical.

3. The receiver of claim 1 further comprising a resilient member between the base and the housing.

4. The receiver of claim 3 wherein the resilient member is a wave washer.

* * * * *